US005630579A

United States Patent [19]

Minami et al.

[11] Patent Number: 5,630,579

[45] Date of Patent: May 20, 1997

[54] AUTOMATIC MANUSCRIPT SHEET FEEDER

[75] Inventors: Kouichi Minami; Mitsuru Wakabayashi, both of Tokyo; Yoshihiro Takahashi, Ebina; Hiroshi Torikai, Matsudo, all of Japan

[73] Assignee: Plus Corp., Tokyo, Japan

[21] Appl. No.: 523,334

[22] Filed: Sep. 5, 1995

[30] Foreign Application Priority Data

Sep. 5, 1994 [JP] Japan ..... 6-235921

[51] Int. Cl.[6] ..... B65H 5/22

[52] U.S. Cl. ..... 271/3.15; 271/3.2; 271/4.02; 271/4.1; 271/902

[58] Field of Search ..... 271/3.15, 3.16, 271/3.17, 3.18, 3.2, 4.02, 4.03, 4.1, 902

[56] References Cited

U.S. PATENT DOCUMENTS

| | | | |
|---|---|---|---|
| 3,370,844 | 2/1968 | Roberts | 271/3.15 |
| 4,913,416 | 4/1990 | Murata et al. | 271/902 |
| 5,090,675 | 2/1992 | Nagai et al. | 271/902 |
| 5,280,903 | 1/1994 | Herrick, Jr. . | |

FOREIGN PATENT DOCUMENTS

| | | | |
|---|---|---|---|
| 0096383 | 6/1983 | Japan | 271/902 |
| 2259633 | 10/1990 | Japan . | |
| 2255474 | 10/1990 | Japan . | |
| 405294497 | 11/1993 | Japan | 271/4.1 |

*Primary Examiner*—H. Grant Skaggs

*Attorney, Agent, or Firm*—Birch, Stewart, Kolasch & Birch, LLP

[57] ABSTRACT

The present invention discloses an automatic sheet feeder to feed manuscript sheets onto and discharge the same from the top of the overhead projector. The automatic sheet feeder comprises a stage glass on which the manuscript is to be set, a common feeding rollers for forward and backward rotations to feed the horizontally or vertically positioned manuscript and a side feeding roller located at a side of the stage glass to carry the manuscript with pressing the upper face of a side edge of the manuscript.

4 Claims, 10 Drawing Sheets

AUTOMATIC MANUSCRIPT SHEET FEEDER

BACKGROUND OF THE INVENTION

1. Field of the Invention

The present invention relates to an automatic manuscript sheet feeder to be used in an overhead projector (hereinafter referred to as OHP), and more particularly relates to an automatic sheet feeder with an improved mechanism for feeding and discharging manuscript sheets.

2. Description of the Prior Art

A prior art of the present invention is an automatic manuscript sheet feeder disclosed in the Japanese Patent Application Laid-open No. 255474/1990.

A conventional manuscript sheet feeder according to the above invention comprises a feeding means having at least a pair of carrying belts for each of the vertical and horizontal manuscript sheets located around the stage glass, a detection means to detect the manuscript direction (vertical or horizontal) and a manuscript feeding amount control means.

A horizontal manuscript placed on the stage glass is carried forward or backward with a pair of carrying belts arranged on both sides of the stage glass (Left and right of the manuscript feeding direction).

In this prior art, if the rotation speeds of the carrying belts are not correctly the same, the left and right edge of the manuscript are carried at different speeds. This causes distortion and float in a part of the manuscript, which may result in unclear OHP image.

On the other hand, the user may sometimes want to manually set the manuscript on the stage glass without using the automatic mechanism. In such case, the carrying belts on the both sides of the stage glass in the above conventional feeder interfere with manual manuscript setting.

The carrying belts are in contact with a large area of the manuscript on the stage glass to take advantage of the frictional force on the contact face for manuscript carrying. This contact tends to damage the manuscript. In addition, a pair of carry belts and their driving mechanisms require many components.

Another prior art is an OHP device with automatic manuscript replacement function disclosed in the Japanese Patent Application Laid-open No. 259633/1990.

A conventional OHP device according to the above prior art comprises a manuscript feeding control means which feeds the manuscript one by one from the manuscript storage section, a collection control means which controls collecting of manuscripts on the reflective plate of the OHP device and bringing of the same to the collection tray and a remote control means which remotely controls the above manuscript feeding control means and the collection control means.

According to this prior art, it is necessary that a holding roller constituting the above manuscript feeding control means and collection control means is always in pressurized contact with the leading or trailing edge of the manuscript. This means that the size and positioning of the manuscript to be fed are limited.

Still another prior art is a sheet plate making device disclosed in U.S. Pat. No. 5,280,903.

This sheet plate making device comprises a tilt table having an upstream end at a higher position and a downstream end at a lower position on its surface, a plurality of discs having surfaces continuous to the table surface, a plurality of rotatable balls opposite to these discs and an edge guide to regulate the sheet direction straightly. By feeding sheets from the above upstream end onto the table and applying rotational force to the back of the sheet with the above discs, the sheet direction is corrected so that the sheet edge goes along the edge guide.

This prior art device is designed to carry sheets between two devices (printer and another device, for example). It is not particularly provided as a manuscript sheet feeder for OHP. In addition, unique ideas such as a tilt table and a rotational discs incorporated in the table according to this prior art cannot be applied as they are to a manuscript sheet feeder for OHP.

Thus, it is an object of the present invention to provide an automatic manuscript sheet feeder with a new structure which prevents distortion, float and damage of the fed manuscript.

It is another object of the present invention to provide an automatic manuscript feeder which facilitates manual setting of manuscript sheets.

It is still another object of the present invention to provide an automatic manuscript sheet feeder which ensures feeding of a horizontal manuscript, whose edge along the feeding direction is shorter than the edge across such direction (width).

SUMMARY OF THE INVENTION

An automatic manuscript sheet feeder according to the present invention to attain the above objects comprises a base placed on the overhead projector, a stage glass mounted to the base, common feeding rollers which make forward and backward rotations to supply a manuscript sheet from the manuscript tray onto the stage glass and to discharge the same from the stage glass, side feeding rollers which are located at a side of the stage glass and make forward and backward rotations in pressurized contact with the upper face of a side edge of the manuscript sheet, a control means to control the rotation of the common feeding rollers and side feeding rollers corresponding to the detected positioning of the fed manuscript sheet and a guide plate to guide the manuscript sheet discharged by the common feeding rollers toward the manuscript receiver.

Other objects, characteristics and effects of the present invention will be clarified by the following description with referring to the attached figures.

DETAILED DESCRIPTION OF THE INVENTION

Figure 1:
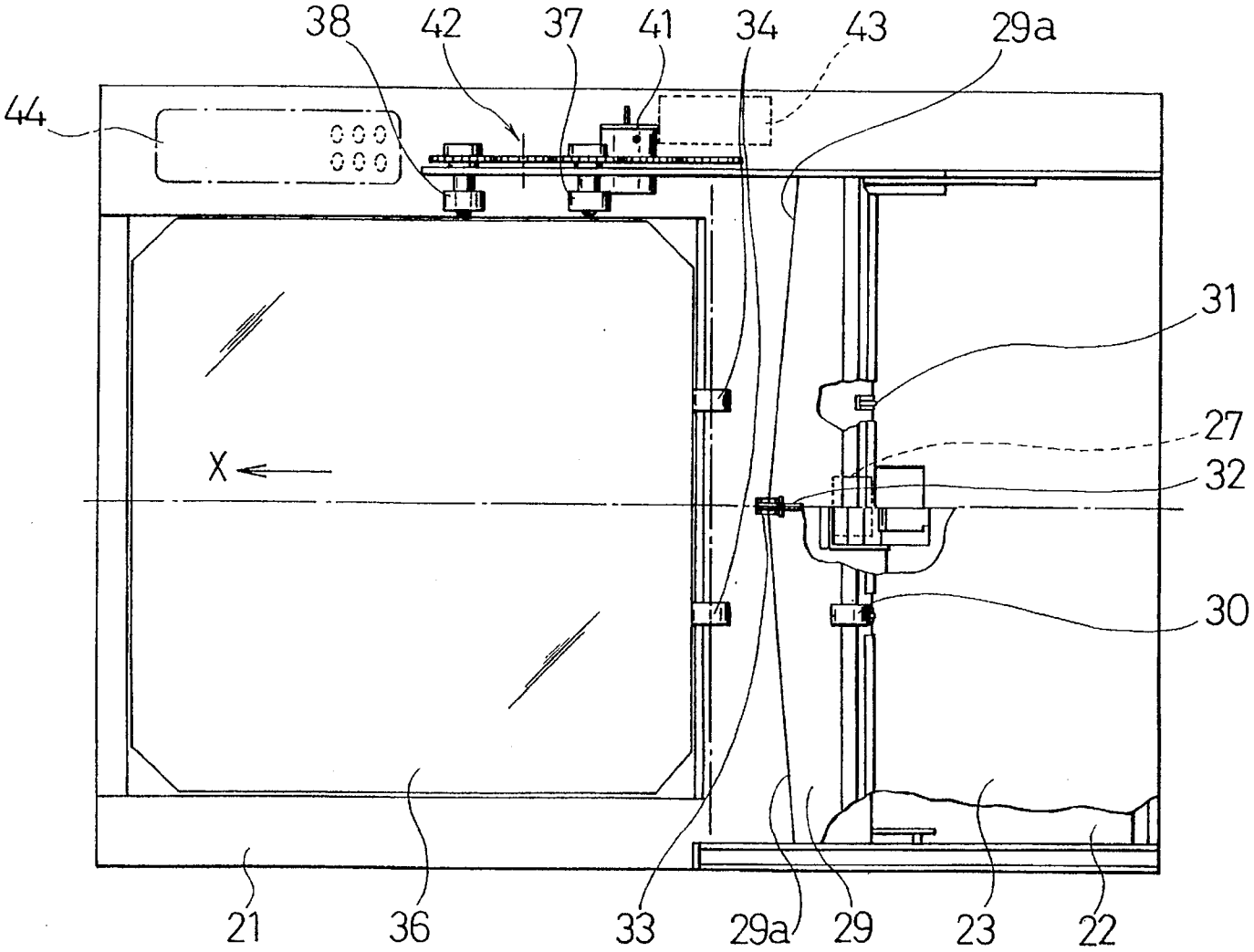
FIG. 1 is a plan view of a preferred embodiment of the present invention with a partial cutaway.
Figure 2:
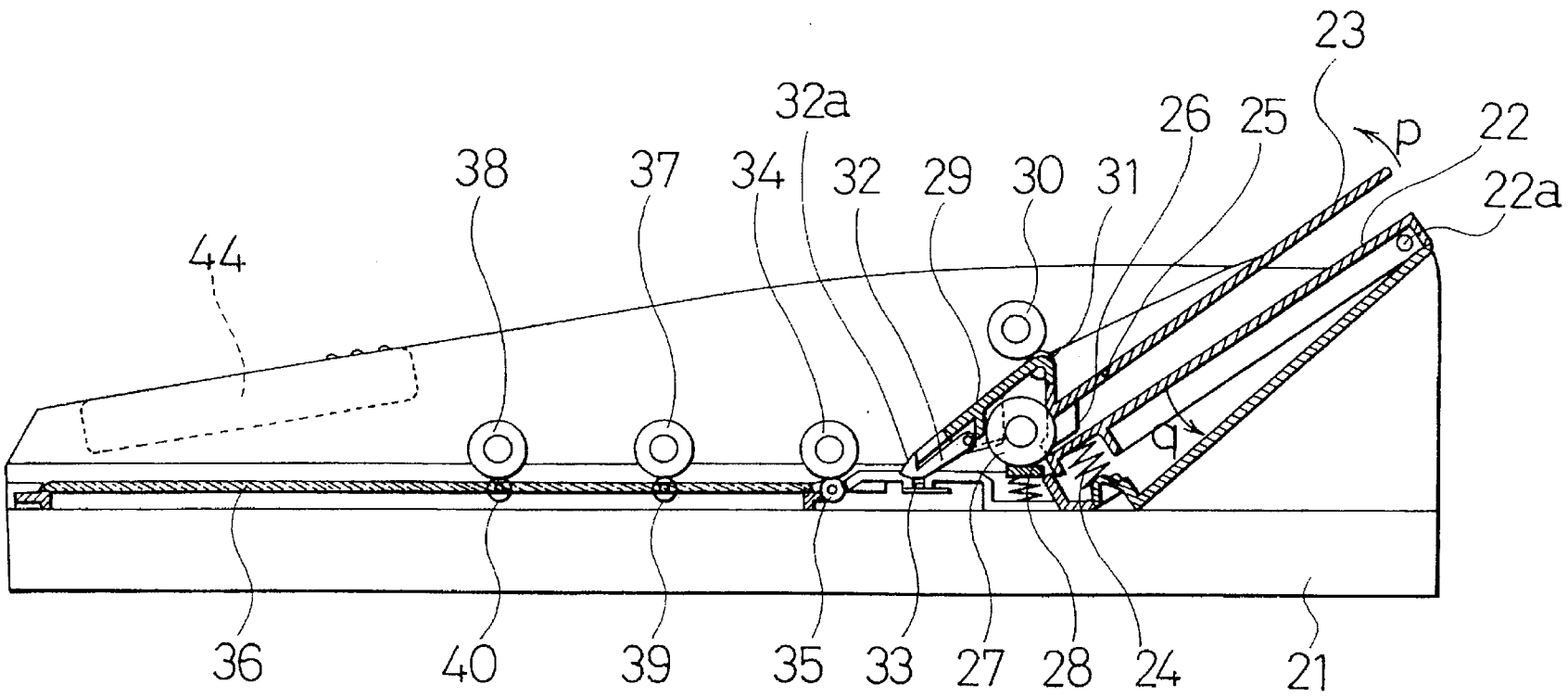
FIG. 2 is a cross sectional view cut at the center of FIG. 1 showing the major part of the invention.

In FIGS. 1 and 2, reference numeral 21 indicates a base placed on the overhead projector (not shown). The base 21 is provided, at its rear end, with a manuscript tray 22 to store manuscripts and a manuscript receiver 23. In addition, as shown in FIG. 2, a spring 24 disposed at the back of the lower end of the manuscript tray 22 and always keeps pressing the manuscript tray 22 toward the manuscript receiver 23.

The manuscript receiver 23 is rotatably supported so that it can rotate about the fulcrum 25 in FIG. 2 in the direction of arrow p. A holding plate 26 is mounted at the lower end of the manuscript receiver 23. When the manuscript receiver 23 is rotated in the direction of arrow p in FIG. 2, the holding plate 26 presses down the lower end of the manuscript tray 22 against the force of the spring 24. This causes the manuscript tray 22 to rotate about the fulcrum 22*a* in the direction of arrow q.

Substantially at the center of the front of the manuscript tray 22 and the manuscript receiver 23, a separating roller 27 is provided to separate and feed the manuscript one by one. A separating plate 28 is placed immediately below the separating roller 27. The separating plate 28 is in pressurized contact with the outer circumference of the separating roller 27 from the bottom because of the restoration force of the spring (59 in FIG. 4).

Figure 3:
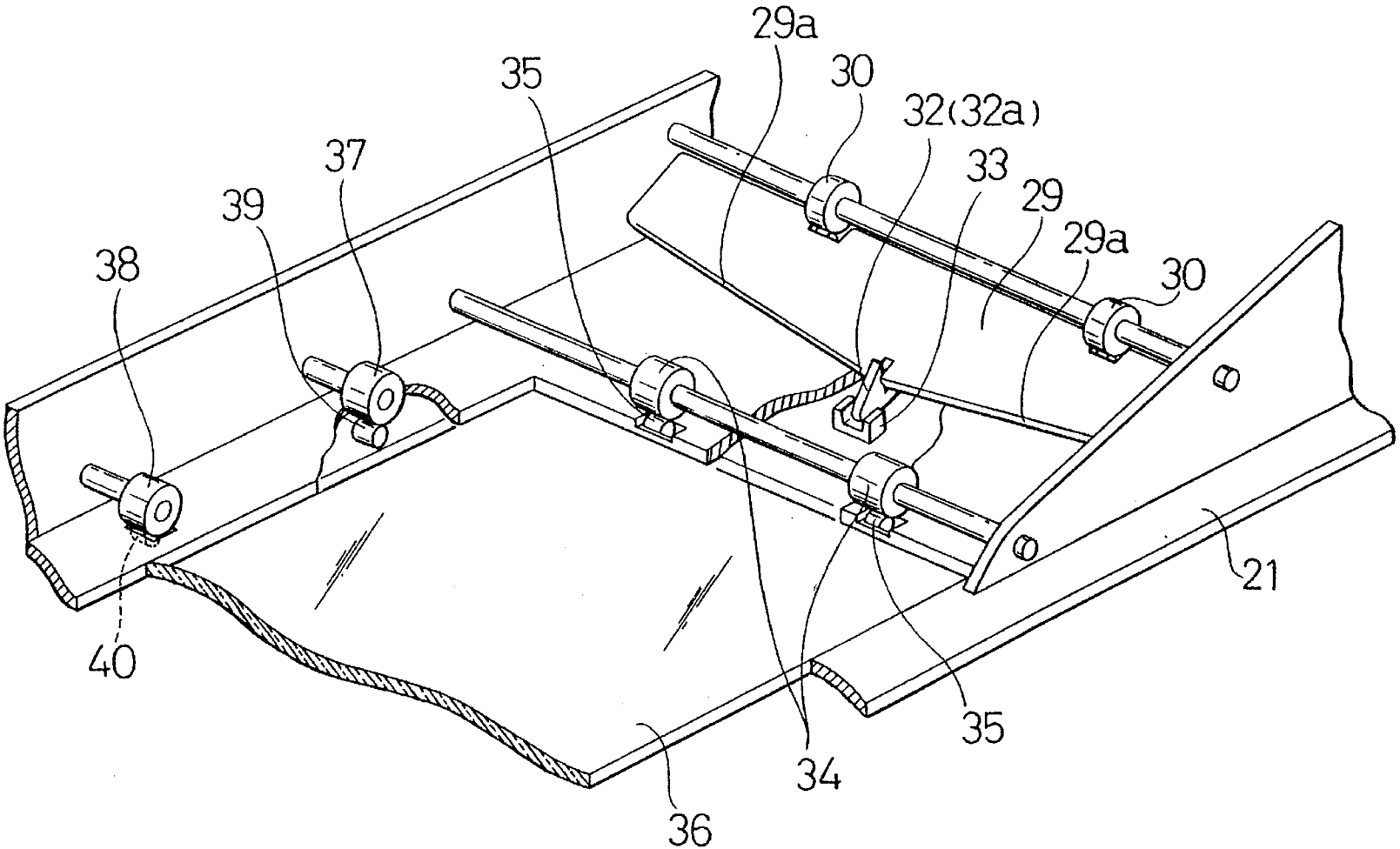
FIG. 3 is a perspective view of the major part in the embodiment of FIG. 1 with a partial cutaway.

A guide plate 29 to guide the discharged manuscript toward the manuscript receiver 23 is located above the separating roller 27. Still above the guide plate 29 are a pair of discharge rollers 30 supported by the axis. As shown in FIGS. 1 and 3, the front edge of the guide plate 29 is formed as an angled edge 29*a* so that the edge slightly retreats toward both sides starting from the center when seen in a plan view.

In FIGS. 1 and 2, reference numeral 31 shows an auxiliary roller to catch the manuscript with the discharging roller 30.

As FIG. 3 shows in details, a sensor lever 32 for manuscript size detection is rotatably mounted below the center part of the guide plate 29. The free end of the sensor lever 32 usually obstructs the light path of a photo interrupter 33 located below. When the leading edge of the manuscript fed from the manuscript tray 22 comes into contact with the free end of the sensor lever 32 from the lower side and raises the free end, the light path of the photo interrupter 33 becomes free from the obstacle. This turns on the photo interrupter 33, which outputs the electric signal.

As a means to cause electric signal output with removing the sensor lever 32 using the leading edge of the manuscript, mechanical or magnetic switch may be used instead of the photo interrupter, The free end of the sensor lever 32 is shaped like an arrowhead. The free end is provided with a guide section 32*a* with a slope substantially continuous to the surface of the guide plate 29. The guide section 32*a* is projecting forward (toward a stage glass 36) from the center of the guide plate 29 and the manuscript discharged from the stage glass 36 firstly runs onto the slope of the guide section 32*a*.

Located in front of the sensor lever 32 are a pair of common feeding rollers 34, which are provided with auxiliary rollers 35 immediately below them.

In front of the common feeding rollers 34, the base 21 is provided with the stage glass 36, which is substantially square-shaped. Side feeding rollers 37 and 38 are provided at a side of the stage glass 36, which may be, for example, the right side of the stage glass 36 when seen toward the manuscript feeding direction (direction of arrow X in FIG. 1). These side feeding rollers 37 and 38 carry the manuscript by forward or backward rotation with contacting pressure on the upper face of a side edge of the horizontal manuscript sheet, which is longer in width.

Immediately below the side feeding rollers 37 and 38 are located auxiliary rollers 39 and 40.

The side feeding rollers 37 and 38 are, as shown in FIG. 1, driven by a motor 41 or a proper gear mechanism 42. The separating roller 27, the discharging roller 30 and the common feeding rollers 34 are also driven by the motor 41 and a gear mechanism (not shown).

In FIG. 1, reference numeral 43 indicates an encoder to detect the manuscript size (length of the manuscript along the direction of arrow X) based on the number of revolutions of the motor 41. The encoder 43 constitutes, together with the sensor lever 32 for manuscript size detection and the photo interrupter 33, a means to detect the manuscript size so as to determine whether the manuscript is horizontal or vertical. A control circuit which controls the number and direction of revolutions at the motor 41 to drive the common feeding rollers 34 and the side feeding rollers 37 and 38 corresponding to the above identification result constitutes a control means of the present invention together with a means to determine the manuscript positioning (vertical or horizontal) as described above.

Reference numeral 44 in FIGS. 1 and 2 indicates a remote controller section to remotely operate the automatic manuscript sheet feeder of the present invention.

Referring now to FIGS. 4 to 11, the operation according to this embodiment is described below.

Figure 4:
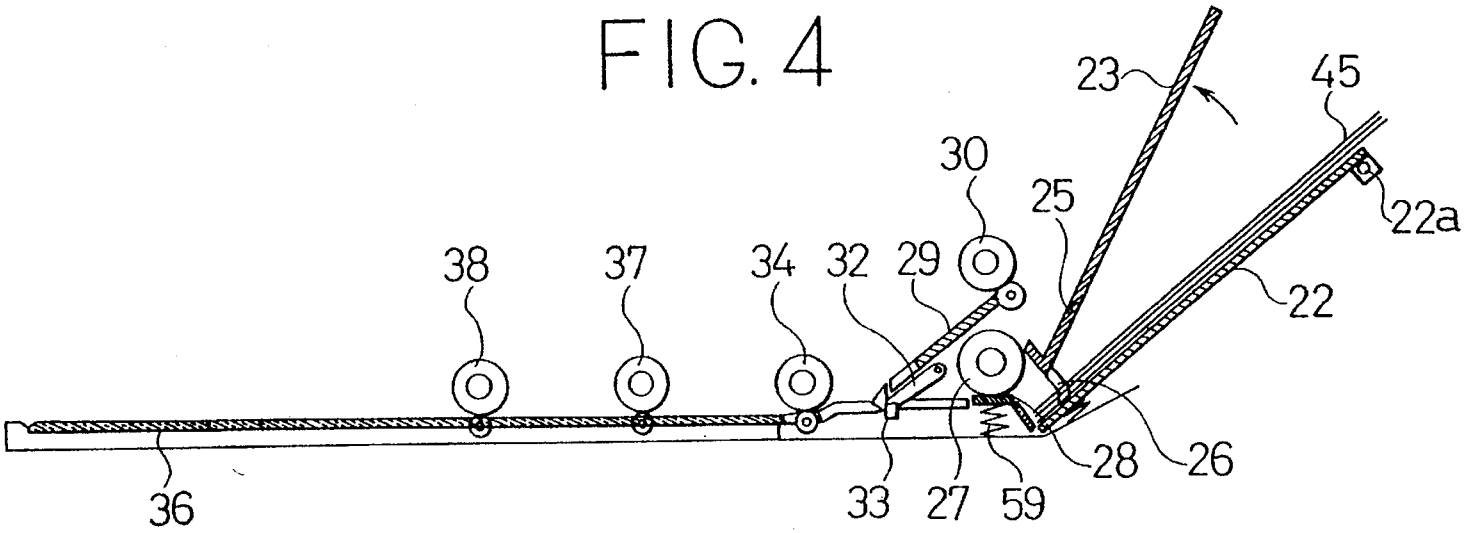
FIGS. 4 to 11 are schematic side elevation views of the major part in the embodiment of FIG. 1 to show its operation.
Figure 5:
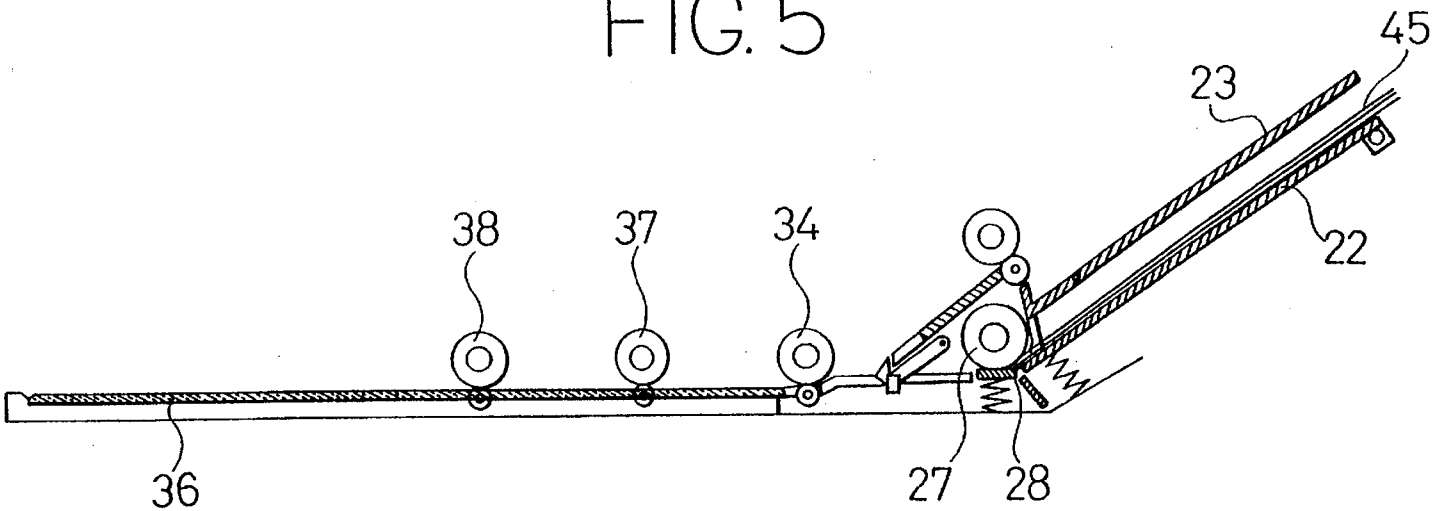

Firstly, when the rear end of the manuscript receiver 23 is raised upward as shown in FIG. 4, the holding plate 26 presses down the lower end of the manuscript tray 22. This enables setting of several sheets of manuscript 45 on the manuscript tray 22. Then, when the manuscript receiver 23 is returned to the original position as shown in FIG. 5, the leading edge of the first sheet of manuscript 45 is in contact with the lower end of the separating roller 27.

Secondly, turning on of the applicable switch (not shown) drives the motor 41, which causes rotation of the separating roller 27. This embodiment has a simple circuit so that the common feeding rollers 34 and side feeding rollers 37 and 38 start rotations at the same time. However, these feeding rollers 34, 37 and 38 may start rotations at a certain time after the start of rotation by the separating roller 27.

Figure 6:
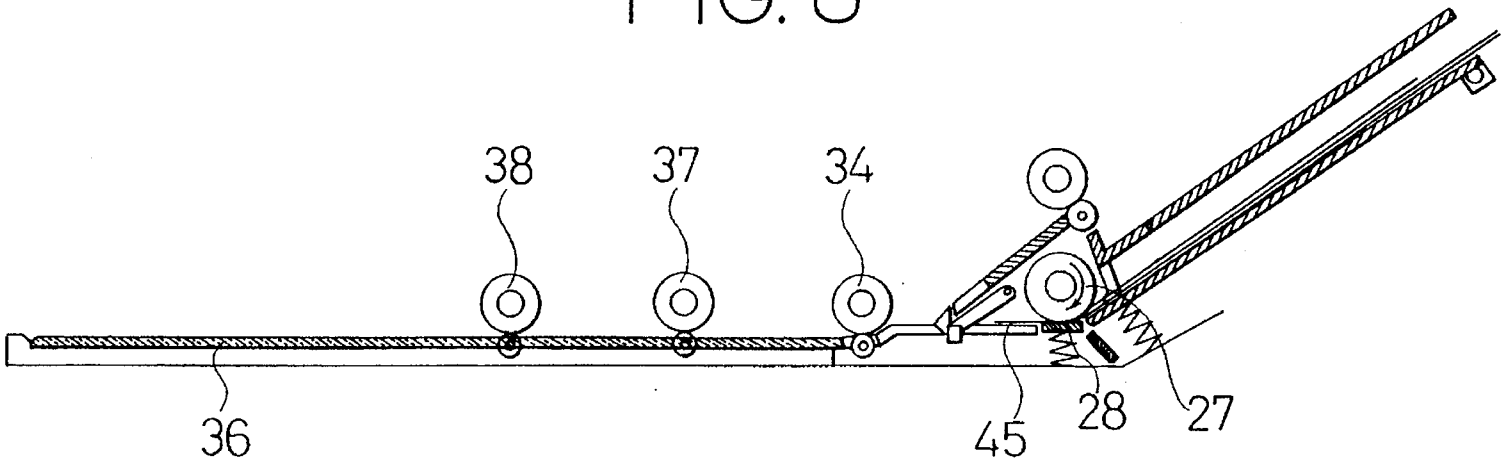

As shown in FIG. 6, the rotation of the separating roller 27 causes the first sheet of manuscript 45 alone to be fed forward with the second and the following sheets of manuscript 45 stopped by the separating plate 28.

Figure 7:
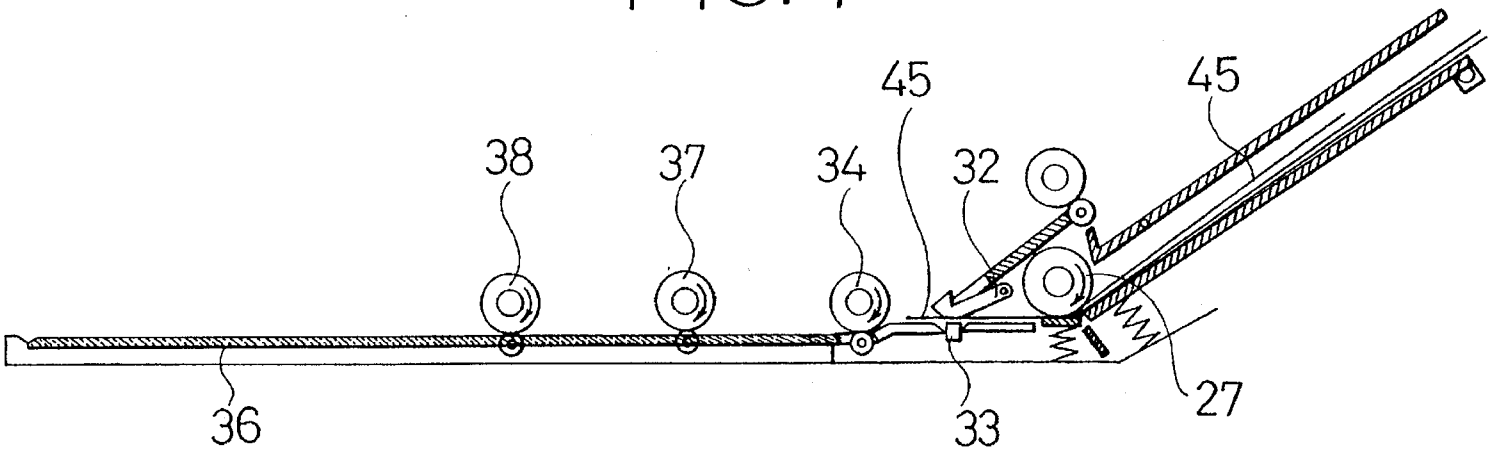

The leading edge of the first sheet of manuscript 45 fed out by the separating roller 27 raises the sensor lever 32 as shown in FIG. 7. This removes the obstacle in the light path of the photo interrupter 33, which is turned on and outputs the electric signal.

The above electric signal is used for detecting the leading edge of the manuscript 45. According to the following output pulse of the encoder 43, which is synchronized with the revolutions at the motor 41, the feeder starts to determine the size of the manuscript sheet (length of the edge along the feeding direction of the manuscript 45).

Further, the manuscript 45 is fed toward the stage glass 36 located much forward by rotation of the common feeding rollers 34.

If the separating roller 27 keeps rotating in this process, it would push out the second sheet immediately after the sending of the first sheet. To prevent this, the rotation of the separating roller 27 is stopped when at least the leading edge of the manuscript 45 is caught by the common feeding rollers 34. Note that the separating roller 27 is designed so that it can rotate freely while the manuscript 45 is carried, by means of a proper one-way clutch mechanism.

Rotation of the common feeding rollers 34 causes the leading edge of the manuscript 45 to be slightly seen at the edge of the stage glass 36. This means that the manuscript has passed through the preceding steps.

The manuscript 45 is further sent forward by rotation of the common feeding rollers 34. When the trailing edge of the manuscript 45 leaves the sensor lever 32, the sensor lever 32 returns to the lower position and obstructs the light path of the photo interrupter 33 to turn it off. The output pulse from the encoder 45 while the photo interrupter 33 has been turned on tells the length of the sheet of manuscript 45. Thus, the feeder can distinguish the horizontal manuscript (with the edge along the manuscript feeding direction being shorter than that across such direction (manuscript width) and the vertical manuscript (with the edge along the manuscript feeding direction being longer than that across such direction (manuscript width)). If the manuscript size is limited to A4 and letter size, for example, the feeder can easily distinguish horizontal and vertical positioning of the manuscript.

Figure 8:
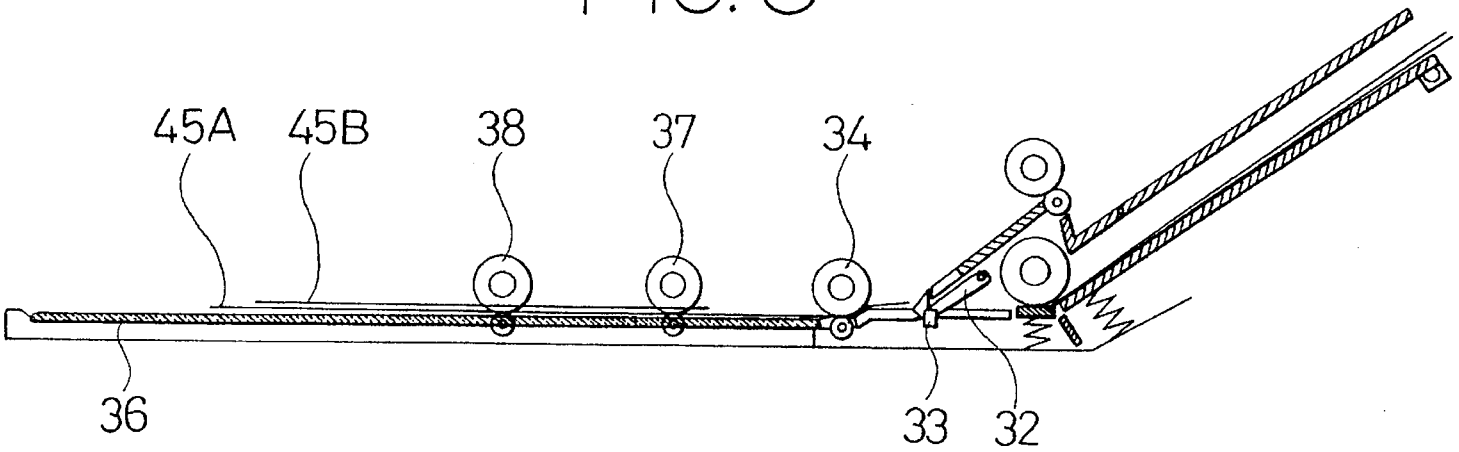

When it is detected that the manuscript is vertically positioned, the control circuit controls the motor 41 to stop the common feeding rollers 34 immediately before the manuscript leaves the rollers 34. In FIG. 8, reference numeral 45A is a vertical sheet of manuscript when the motor 41 stops.

Operation of the feeder when it is detected that the manuscript is horizontally positioned is as described below. In this case, the control circuit controls the motor 41 to stop the feeding rollers 37, 38 and 34 when the manuscript has left the common feeding rollers 34 and is about to leave, among a pair of side feeding rollers 37 and 38, the rear side feeding roller 37. In FIG. 8, reference numeral 45B is a horizontal sheet of manuscript then the motor 41 stops.

For convenience of explanation, the vertical manuscript 45A and the horizontal manuscript 45B are overlaid in FIG. 8. It is needless to say, however, that they are separately fed in actual operation.

The steps shown in FIGS. 4 to 8 above relate to feeding of the manuscript onto the stage glass 36. The manuscript 45A or 45B thus fed onto the stage glass 36 is placed in the light from the OHP light source (not shown) so that the characters on the manuscript 45A or 45B are projected.

In the above embodiment, the horizontal manuscript 45B is initially carried by the common feeding rollers 34 alone. Then, after the trailing edge of the manuscript 45B leaves the common feeding roller 34, a pair of side feeding rollers 37 and 38 in pressurized contact with the upper face of a side edge of the manuscript 45B rotates to carry it on the stage glass 36.

As described for the prior art, when both sides of the manuscript 45B are in pressurized contact with the rollers for carrying, a slight difference in rpm between the rollers may cause difference in feeding speed of various parts of the manuscript, which may result in distortion or floating at a part of the manuscript 45B. In this embodiment, however, a single side of the manuscript 45B is held by the side feeding rollers 37 and 38 with the other side left free. This eliminates the possibility of distortion or floating of the manuscript 45B.

In addition, this embodiment is not provided with any obstacle. This facilitates manual setting of the manuscript from the front or from the side opposite to the side feeding rollers 37 and 38 (left side when directed toward the manuscript feeding direction) onto the stage glass 36. It is convenient to manually feed the manuscript when necessary.

Figure 9:
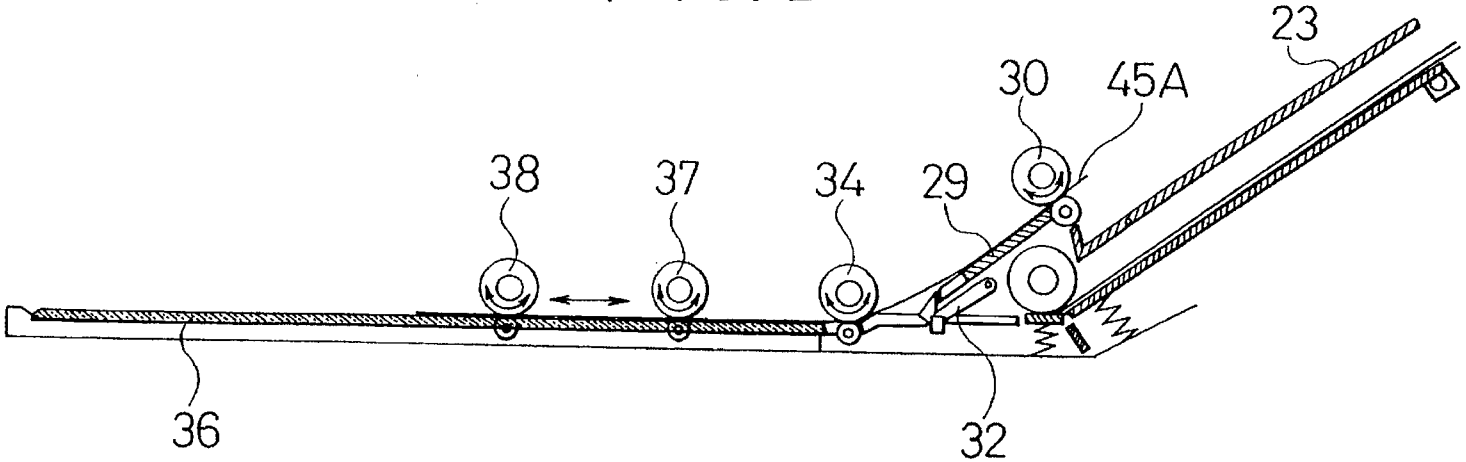

Described now is the fine adjustment operation for the manuscript position. FIG. 9 shows the operation in fine adjustment. As an example, a vertical manuscript 45A is shown here.

The fine adjustment can be arbitrarily made for both forward and backward directions provided that the manuscript 45A does not leave the common feeding rollers 34. The position of the manuscript 45A can be checked by the output pulse of the encoder 43 synchronized with the forward and backward revolutions of the motor 41. For a horizontal sheet of manuscript 45B, the side feeding rollers 37 and 38 as well as the common feeding rollers 34 make forward and backward revolutions for fine adjustment.

Figure 10:
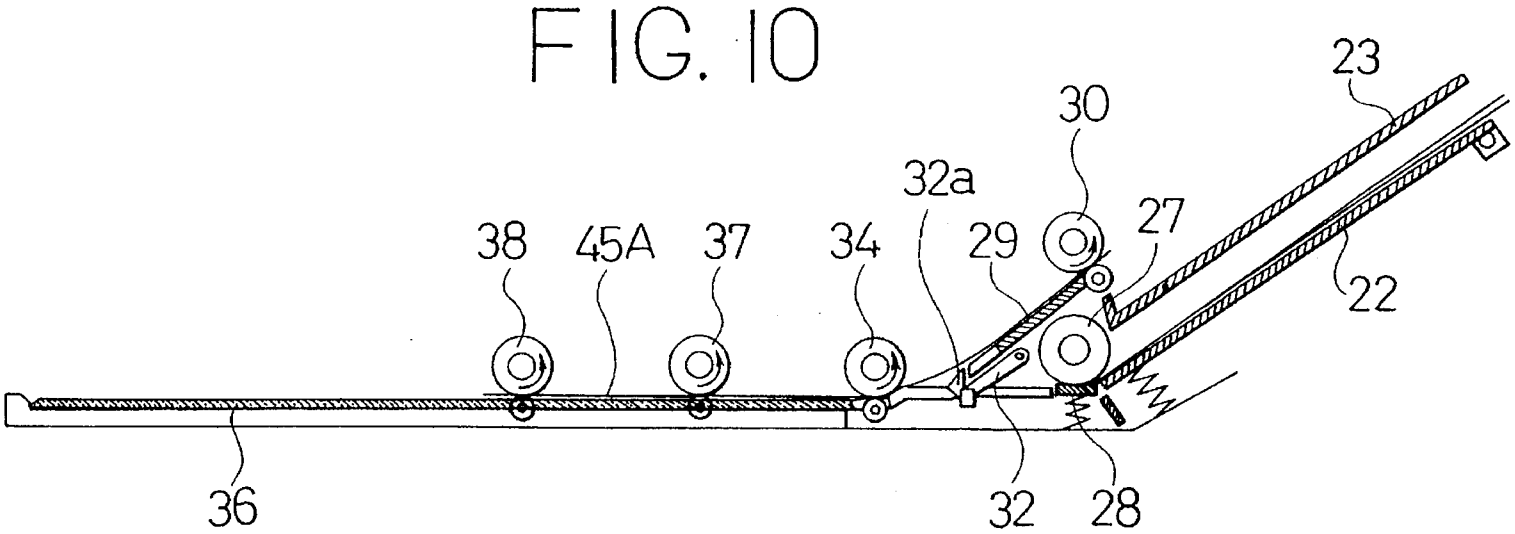
Figure 11:
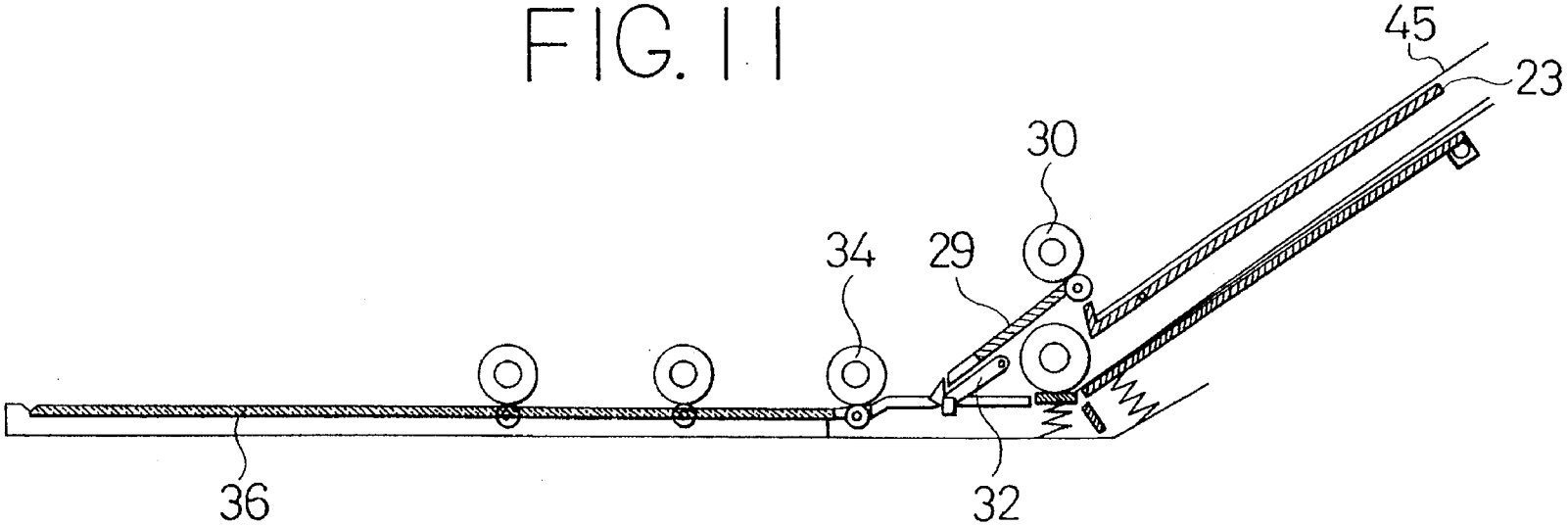

FIGS. 10 and 11 show the manuscript sheet discharge operation. Note that a vertical sheet of manuscript 45A is shown again in these figures.

When the manuscript 45A is discharged, as shown in FIG. 10, the common feeding rollers 34 and the discharge roller 30 make reverse rotations. For a horizontal sheet of manuscript 45B, side feeding rollers 37 and 38 also make revolutions in addition to this.

Here, the leading edge of the manuscript (reference numeral 45 is used when it is not necessary to distinguish whether it is horizontal or vertical) fed backward from the common feeding rollers 34 runs up to the upper part of the slope on the guide section **32*a* of the sensor lever 32, which is projecting from the center part of the guide plate 29. Then, the manuscript 45 is discharged smoothly toward the guide plate 29 located beyond the slope. This means that the discharged manuscript 45 is not sent toward the separating roller 27. In addition, there is no possibility that the manuscript 45 causes a jam or goes into the manuscript on standby situation of the manuscript tray 22**.

FIG. 11 shows the status where, upon completion of discharge, the manuscript 45 is stored in the manuscript receiver 23. The common feeding rollers 34 and the discharge roller 30 stop their rotations at this point.

The discharge roller 30 is provided with a one-way clutch similarly to the separating roller 27. As shown in FIG. 9, the discharge roller 30 can make both forward and backward rotations synchronizing with the feeding rollers 34, 37 and 38. However, if the manuscript 45 has a warp and its trailing edge is caught by the discharge roller 30, rotation of the discharge roller 30 in feeding direction (reverse to the discharge direction) for subsequent sheet feeding together with the feeding rollers 34, 37 and 38 causes the previously discharged manuscript to be fed again toward the stage glass 36.

A one-way clutch to drive the discharge roller 30 in the discharge direction only and prevent its rotation in the feeding direction eliminates the possibility of unintended feeding of a discharged manuscript.

In the above embodiment, the sensor lever 32 serves as an actuator to turn on and off the photo interrupter 33 so as to detect the manuscript size. It also serves as a guide member in manuscript discharging, ensuring that the manuscript runs onto the guide plate 29 and guides it toward the discharge roller 30 and the manuscript receiver 23.

In other words, a single member referred to as the sensor lever 32 can be used for a plurality of functions in this embodiment. This results in a reduced number of components and reduced costs.

Figure 12:
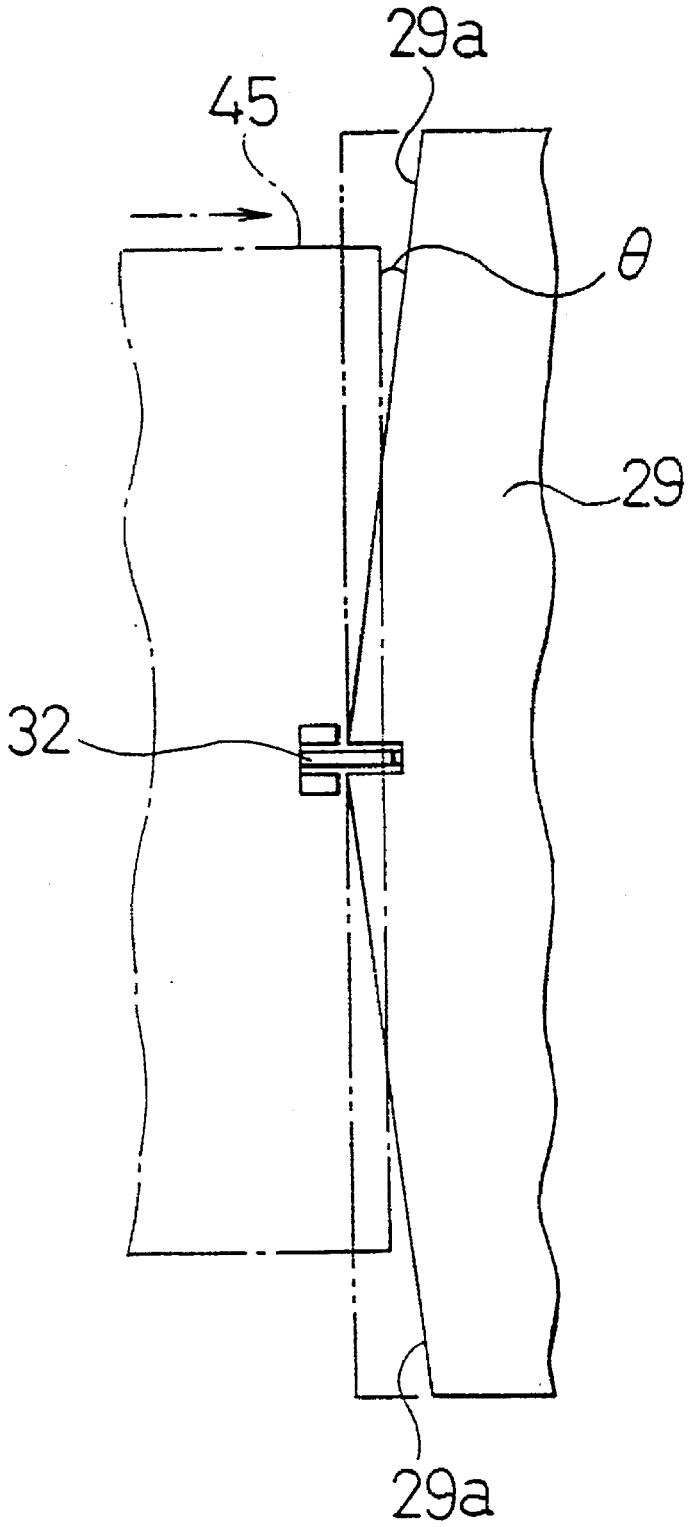
FIG. 12 is an explanatory view to describe the effect of the angled edge in a preferred embodiment of the present invention.

By forming the angled edge 29*a* at the front of the guide plate 29, as shown in FIG. 12, the leading edge of the manuscript 45 with its center part running onto the sensor lever 32 runs onto the guide plate 29 keeping in contact with only two points on the angled edge 29*a* with angle theta. In other words, if the front edge of the guide plate 29 constitutes a straight line perpendicular to the discharge direction of the manuscript 45 as shown in broken lines in FIG. 12, the leading edge of the manuscript 45 comes into contact with the front edge of the guide plate 29 at several points. Under such situation, a warp of the manuscript may cause the manuscript to be caught by the guide plate 29.

This embodiment is free from such possibility. Even when the manuscript 45 has a slight warp, it can be smoothly discharged.

Though not shown in the figure, the guide plate 29 may be provided with several sensor levers 32 along its front edge.

The angled edge 29*a* formed at the front edge of the guide plate 29 preferably has a curved top face so as to discharge the manuscript 45 smoothly. The above angled edge 29*a* may be also formed as a straight line which extends obliquely when seen from the top.

The driving mechanism of the separating roller 27 is described below in details. As described above, the separating roller 27 is driven until the first sheet of manuscript 45 on the manuscript tray 22 is sent to the common feeding roller 34. After such manuscript sending to the common feeding rollers 34, the separating roller 27 loses the driving force and makes free rotation under the influence of friction with the moving manuscript 45 until the trailing edge of the manuscript 45 goes out of the separating roller 27.

The separating roller 27 is provided with a one-way clutch in its driving mechanism so as to prevent any trouble when it rotates under the friction with the manuscript 45.

The separating roller 27 has a driving period different from that for the common feeding rollers 34. For this reason, it is a common practice to provide a special motor to drive the separating roller 27 independently from the one to drive the common feeding rollers 34.

However, the addition of a special motor for the separating roller 27 leads to a higher cost. At the same time, driving of a plurality of motors requires a higher capacity of the power supply.

Suppose now a separating roller 27 is to be driven by the motor to drive the common feeding rollers 34. In this case, an additional encoder to detect the feeding amount becomes necessary for correct detection of the feeding amount of the manuscript fed to the common feeding rollers 34. This results in a much higher cost.

In this embodiment, the feeder is designed so that the motor to drive the common feeding rollers 34 can be used for driving the separating roller 27, and at the same time, that the driving period of the separating roller 27 can be correctly set by a mechanical means.

Figure 13:
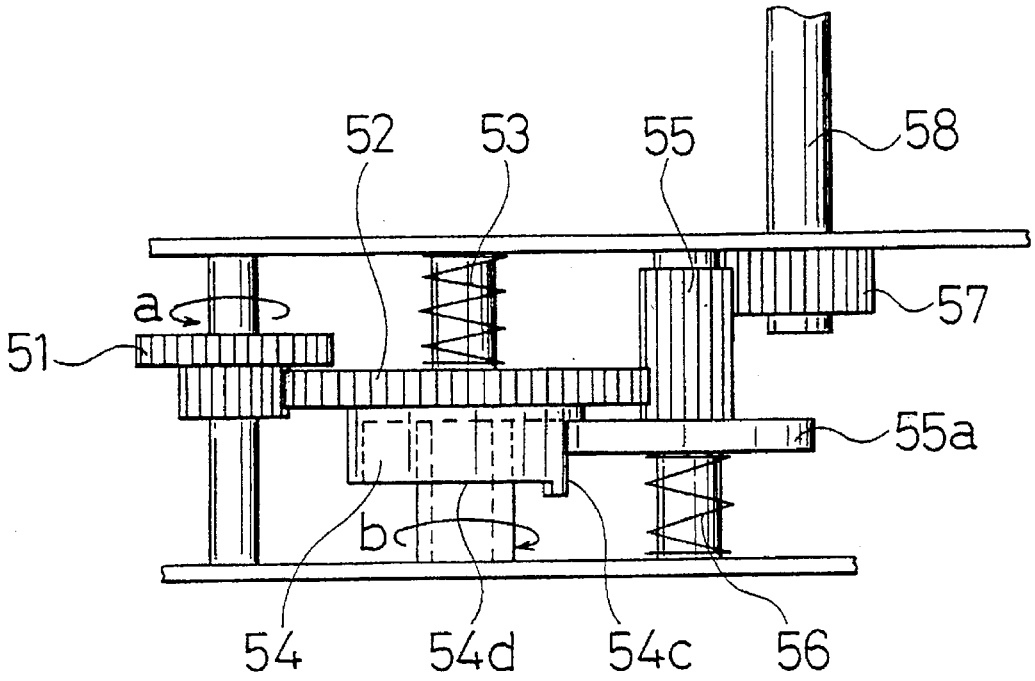
FIGS. 13 to 15 are explanatory views to describe the operation of the separating roller driving mechanism in a preferred embodiment of the present invention.

In FIG. 13, reference numeral 51 indicates a gear constituting a part of a gear mechanism to rotate the common feeding rollers 34. The power of the gear 51 is transmitted to the gear 52.

Below the gear 52, a switching cam 54 formed separately from the gear 52 is in pressurized contact under the force of the spring 53. When the gear 51 rotates in the direction of arrow a in FIG. 13, the gear 52 and the switching cam 54 rotate together in the direction of arrow b.

Figure 14:
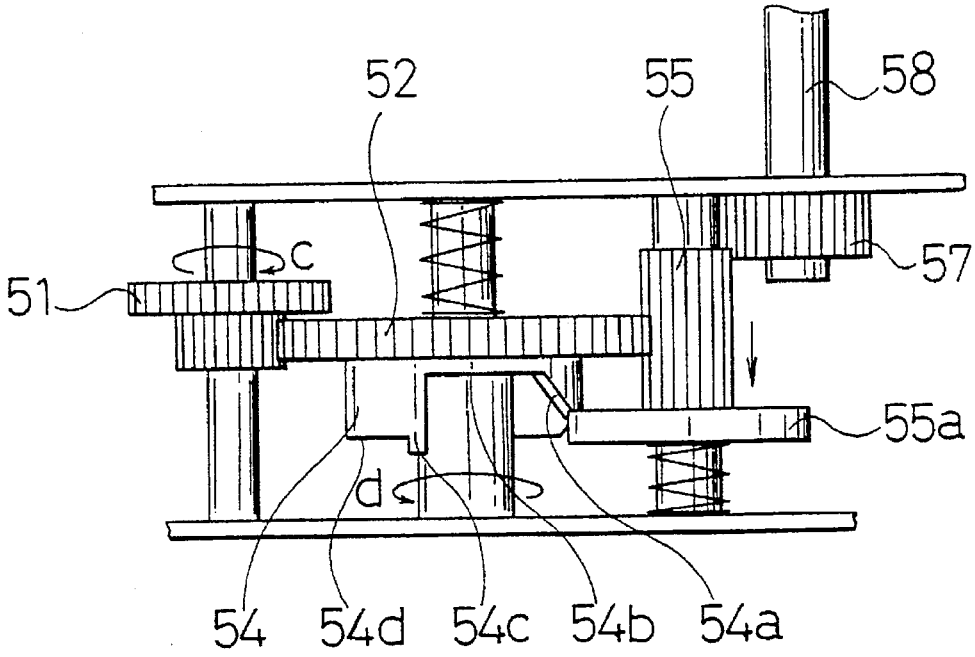

Describing in further details, the switching cam 54 is, as shown in FIG. 14, provided with a taper section 54*a*, a horizontal section 54*b*, a stopper 54*c* and another horizontal section 54*d*. A flange 55*a* of a switching gear 55 adjacent to the gear 52 comes into contact with the lower face of the taper section 54*a*, the horizontal section 54*b* and then 54*d* sequentially.

The flange 55*a* above is always pressed upward by a spring 56. As the switching cam 54 rotates, the horizontal section 54*b*, the taper section 54*a* and then the horizontal section 54*d* sequentially come into contact with the flange 55*a*, and the switching gear 55 moves in the axial direction.

The switching gear 55 is engageable with the separating gear 57, which is fixed to an axle 58 of the above separating roller 27. The separating gear 57 has an incorporated one-way clutch, which transmits the power to the axle 58 for the rotation in the predetermined direction and prevents the power transmission to the axis 58 during backward rotation.

Vertical operation of the switching gear 55 described above causes the power of the switching gear 55 to be transmitted to the separating gear 57 for a certain period only. This causes the separating roller 27 to rotate via the axle 58.

In the above embodiment, the power for the switching gear 55 is obtained from the gears 51 and 52. However, this may be obtained from driving systems such as side feeding rollers 37 and 38.

In such a configuration, when the manuscript 45 is fed, the gear 51 rotates in the direction of arrow c in FIG. 14 and the gear 52 and the switching cam 54 rotate in the direction of arrow d.

Here, the switching cam 54 starts rotation from the position where its horizontal section 54*b* is in contact with the flange 55*a* of the switching gear 55. While the flange section 55*a* is in contact with the horizontal section 54*b* and the taper section 54*a*, the switching gear 55 is engaged with the separating gear 57 and the separating roller 27 makes rotation via the axle 58 to carry the manuscript 45 toward the common feeding rollers 34.

When the horizontal section 54*d* of the switching cam 54 comes into contact with the flange 55*a*, the switching gear 55 is released from the separating gear 57 and the separating roller 27 stops its rotation. The length of the horizontal section 54*b* and the taper section 54*a* are designed so that the leading edge of the manuscript 45 sent from the separating roller 27 is caught by the common feeding rollers 34 under such situation.

Figure 15:
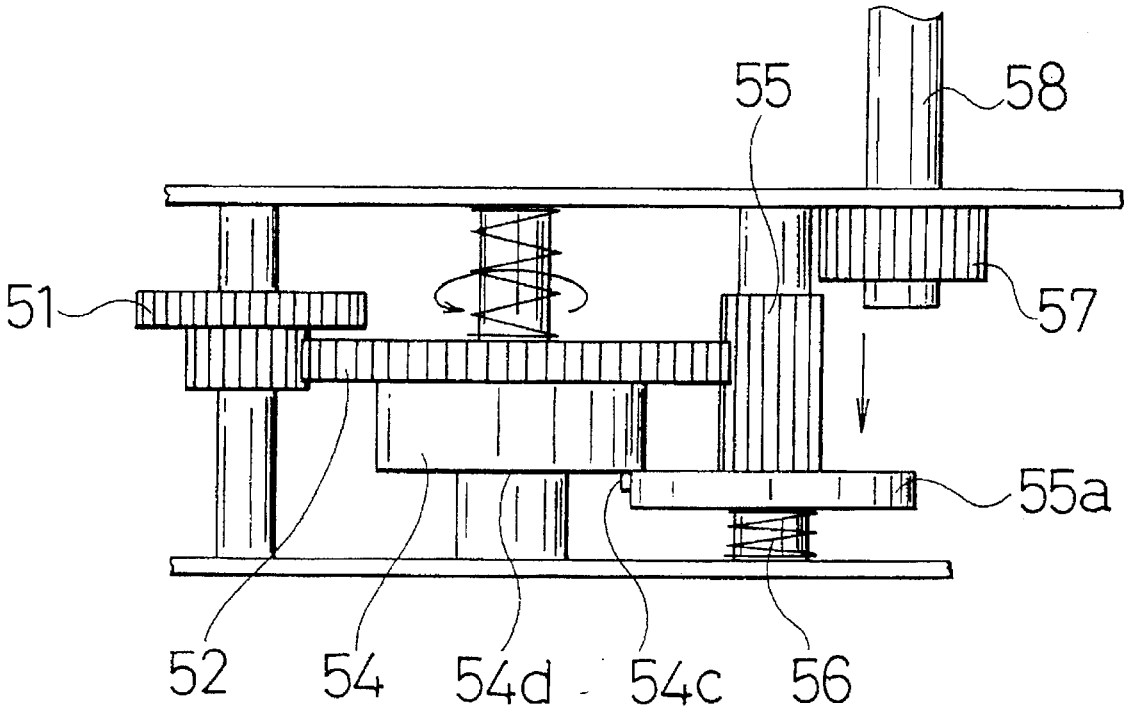

Then, the common feeding rollers rotate so as to continue the feeding operation of the manuscript 45. When the switching cam 54 rotates and its stopper 54*c* comes into contact with the flange 55*a*, the switching cam 54 stops its rotation and the gear 52 alone rotates without any engagement. FIG. 15 shows this situation.

When the manuscript 45 is carried to the position shown in FIG. 8, the common feeding rollers 34 and the gears 51 and 52 stop their rotations.

For fine positional adjustment of the manuscript 45 after feeding, it is necessary to arrange the size of the switching cam 54 so that, even when the longest manuscript is fed, the stopper 54*c* of the switching cam 54 is free from any contact with the flange 55*a*. If not, the separating roller 27 might feed the next manuscript in repetition of the manuscript position adjustment.

In discharge of the manuscript 45, the gear 51 rotates in the direction of arrow a in FIG. 13 and the gear 52 rotates in the direction of arrow b. The switching cam 54 starts rotation together with the gear 52 from the position where the flange section 55*a* of the switching gear 55 is in contact with the stopper 54*c* as shown in FIG. 15. The switching cam 54 continues to rotate until the flange 55*a* goes through the horizontal section 54*d*, the taper section 54*a* and the horizontal section 54*b* and reaches the other side of the stopper 54*c*. After that, the switching cam 54 stops its rotation and the gear 52 alone rotates without any engagement.

Rotation of the gear 52 causes rotation of the switching gear 55, the power of which is transmitted to the separating gear 57. However, the one-way clutch incorporated in the separating gear 57 prevents the axle 58 from rotating, resulting in no rotation of the separating roller 27.

By repeating the operation above, the separating roller 27 rotates in one direction for a limited period during feeding of the manuscript 45 toward the stage glass 36 only. Thus, this embodiment enables stable and secure driving of the separating roller 27 with a simple mechanism, though the motor 41 to drive the common feeding rollers 34 is also used for driving of the separating roller 27.

It is to be understood that the foregoing relates to only a preferred embodiment to clearly show the technical contents of the present invention. It is obvious that the present invention is not limited to the above embodiment and various changes and modifications can be made to the invention without departing from the spirit and scope of the invention as hereinafter claimed.

We claim:

1. An automatic manuscript sheet feeder to be used for feeding manuscript sheets for an overhead projector comprising:

a base for placement on the overhead projector, a stage glass mounted onto said base, a manuscript tray, a manuscript receiver, common feeding rollers for forward and backward rotations to feed the manuscript sheet from the manuscript tray to the stage glass and to discharge the manuscript sheet from the stage glass, side feeding rollers located at one side of the stage glass to make forward and backward rotations keeping pressurized contact with an upper face of a side edge of the manuscript sheet, control means to determine the positioning of the manuscript sheet which is being fed and to control rotations of the common feeding rollers and the side feeding rollers corresponding to the determined positioning of the manuscript sheet, and a guide plate to guide the manuscript sheet discharged by the rotation of the common feeding rollers toward the manuscript receiver.

2. The automatic manuscript sheet feeder of claim 1 wherein said control means further comprises a sensor lever to generate ON and OFF signals when triggered by the leading and trailing edges of the manuscript, and said sensor lever having a guide section to regulate the manuscript discharge direction so that the discharged manuscript runs onto the guide plate.

3. The automatic manuscript sheet feeder of claim 2 wherein said guide plate is provided with an inclined edge which makes an oblique intersection with the leading edge of the discharged manuscript.

4. The automatic manuscript sheet feeder of claim 1 wherein said guide plate is provided with an inclined edge which makes an oblique intersection with the leading edge of the discharged manuscript.

* * * * *